United States Patent [19]

Bäckström et al.

[11] Patent Number: 5,050,807

[45] Date of Patent: Sep. 24, 1991

[54] CRUSHER

[75] Inventors: Pekka Bäckström; Juhani Lystilä, both of Kauhajoki, Finland

[73] Assignee: Onninen Oy, Kauhajoki, Finland

[21] Appl. No.: 479,534

[22] Filed: Feb. 13, 1990

[30] Foreign Application Priority Data

Feb. 15, 1989 [FI] Finland ..... 890710

[51] Int. Cl.[5] ..... B02C 18/08

[52] U.S. Cl. ..... 241/101 R; 241/158

[58] Field of Search ..... 241/236, 158, 242, 243, 241/293, 189 A, 101 R, 135

[56] References Cited

U.S. PATENT DOCUMENTS 460,341 9/1891 LeClair ..... 241/158
4,355,765 10/1982 Parker et al. ..... 241/158 X
4,545,538 10/1985 Prew ..... 241/242 X

FOREIGN PATENT DOCUMENTS 811079 10/1982 Finland .
1468662 3/1977 United Kingdom .

*Primary Examiner*—Mark Rosenbaum
*Attorney, Agent, or Firm*—Pollock, Vande Sande & Priddy

[57] ABSTRACT

A crusher includes a housing for supporting a rotating element, preferably a roll-like element, which is adapted to feed the material to be crushed to the cutter elements, which are also attached to the housing of the crusher, and functions as the counter element for the cutter elements in the crushing operation. The first cutter element set is intended for cutting of, for example, wooden material upon rotation of the rotating element in a first direction. The second cutter element set is intended especially for crushing peat upon rotation of the rotating element in another direction opposite to the first rotating direction.

7 Claims, 1 Drawing Sheet

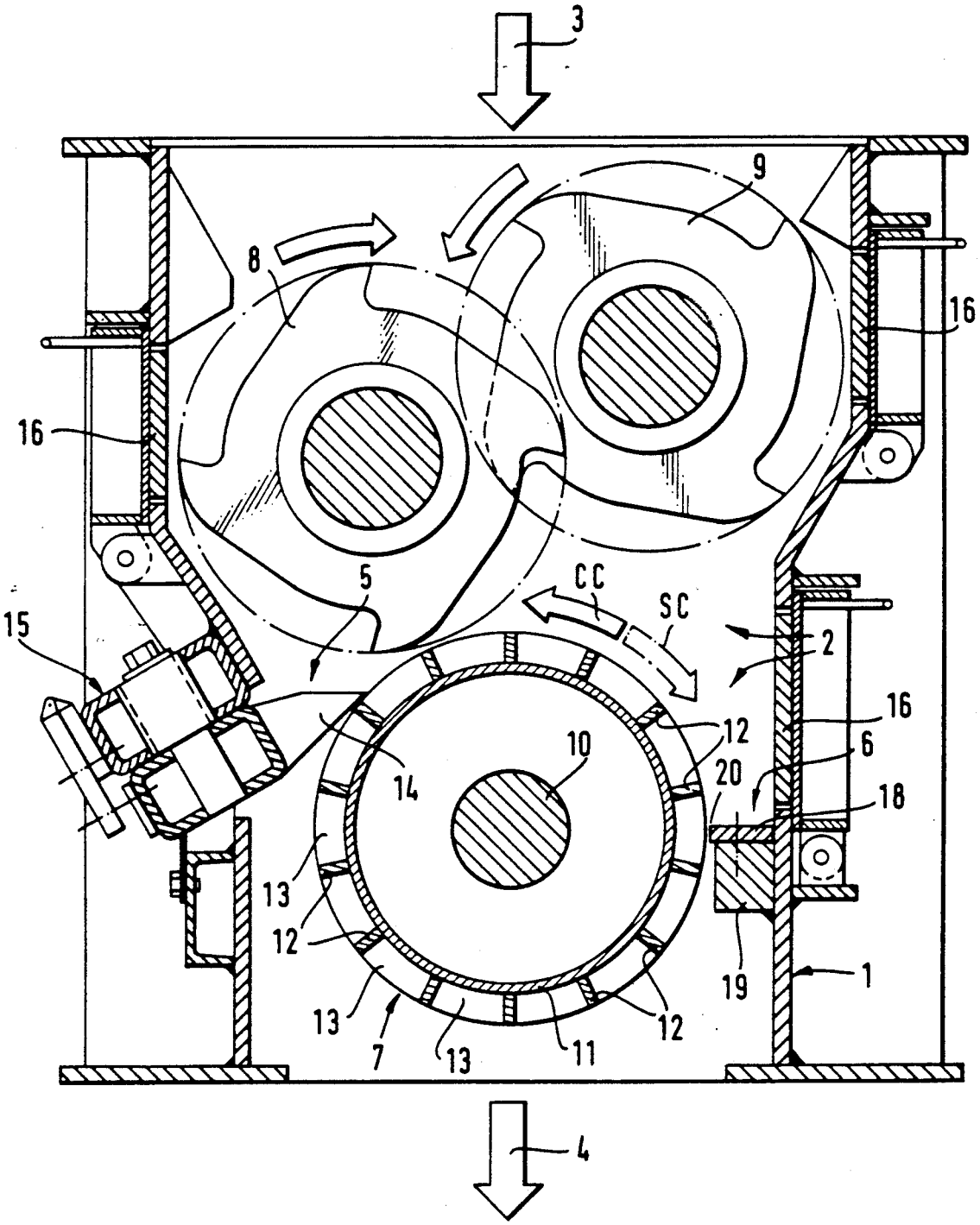
3
9
8
16
16
5
CC
SC
2
15
16
12
10
6
14
20
18
13
12
19
1
13
12
7
13
11
4

CRUSHER

BACKGROUND OF THE INVENTION

The invention relates to a crusher; in particular, a crusher for solid fuel material.

In several incineration plants, which are designed to incinerate so called domestic fuel, such as wood chips, peat or similar, there are problems arising at the crushing stage, when the fuel material is crushed to the size suitable for burning or incineration. The combustion plant using so called domestic fuel can be driven with peat as well as with wooden chips. If the fuel material is merely wooden, it must be crushed before burning. On one hand, if the material consists of milled peat, it contains peat which is to be processed to the size suitable for burning, as well as bigger wooden parts, such as twigs, stubs and roots, which must be crushed into chips. Further, if the material consists of sod peat, it must be crushed to the size suitable for burning.

SUMMARY OF THE INVENTION

The main purpose of this invention is to provide a crusher, especially for a combustion plant which would be suitable to process various fuel materials particularly peat in various forms and wooden parts, such as building material waste, stubs, twigs and roots.

In order to achieve this purpose, the crusher in accordance with the invention is mainly characterized in that to the housing of the crusher has been attached a rotating element, preferably a roll-like element, which has been arranged to feed the material to be crushed to the cutter elements, which have been likewise attached to the housing of the crusher, and to function as the counter element of the crushing, that the first cutter element set is adapted for the first material group whereupon the rotating element has been arranged to rotate in a first direction, and that the second cutter element set is adapted for the second material group whereupon the rotating element has been arranged to rotate in another direction, opposite to the first rotating direction.

By arranging two sets of cutter elements in the above manner, the structure of which is suitable for crushing different materials and by changing the rotating direction of the rotating element in accordance with the material coming into the crusher, a versatile crusher is provided, which can serve in a versatile way especially in connection with a combustion plant using so called domestic solid fuel.

In the following description the crusher in accordance with the invention will be illustrated more in detail. In the specification will be referred to the attached drawing, which represents a sectional elevation of an application of the crusher in accordance with the invention.

DETAILED DESCRIPTION OF THE PREFERRED EMBODIMENT(S)

In the steel framework or housing 1 the crusher represented in the drawing comprise a crushing zone 2, in which the material to be crushed is fed from the upper part of the housing (arrow 3). The crushed material exits from the lower part of the housing in the direction indicated by arrow 4.

The elements accomplishing the crushing, which are situated in the crushing zone comprise the following parts: the first cutter element set 5, the second cutter element set 6, the rotating element 7 and the preliminary crusher rolls 8 and 9 or the like.

The rotating element, preferably a roll-like element, has been mounted in bearings to the housing 1 to rotate around the shaft 10. It is situated in the lower part of the housing 1. The first cutter element set 5 and the second 6 cutter element set are attached to the opposite walls of the housing 1 so that the rotating element 7 is situated between them, whereupon the cutter edges of the cutter element sets 5 and 6 are arranged in a cooperational cutting relationship with the surface of the rotating element. The rotating element 7 comprises a cylindrical surface 11, from which project radial walls 12 spaced equally along the circumference of the surface 11. The radial walls 12 define the outer surface of the rotating element and compartments 13, which are formed between the radial walls and the surface 11 of the rotating element 7. The height of the walls 12 defines the depth of the compartments by means of which one of the dimensions of the material to be crushed will be achieved, when the material to be crushed enters the compartment set 13 of the rotating element 7 before moving either to the first 5 or the second 6 cutter element set.

When the rotating element is rotating according to the direction arrow CC from the right to the left, the material to be crushed is led to the first cutting element set 5, which operates with cutting principle. The first cutting element set 5 is intended for crushing of wooden materials. The cutter 14 is attached to the cutter holder 15, which in turn is attached to the housing of the crusher 1. It is clear, that the cutter 14 is designed to allow for easy replacement and service. This construction will not be explained in more detail in this specification, as it belongs to the field of a professional's know-how. Housing 1 is provided with service caps represented by reference numerals 16, allowing for access to the elements 5, 6, 8 and 9 in the crushing zone, whereupon the service and repairs can take place either inside the housing 1 in the crushing zone 2, or outside the housing.

When the rotating element rotates according to the direction arrow SC from left to the right, the material to be crushed, which in this case is peat, and in particular sod peat in particular, is led to the second cutter element set 6, which is constituted of a cutter bar 18, attached to the bar body 19 supported in the housing 1. The cutter bar 18, the crushing edge 20 of which is preferably parallel to the rotating shaft of the rotating element 7, functions on a so called shocklike principle, whereupon the material transported by the rotating element to the second cutter element set 6 will be crushed.

Above the rotating element 7 there are two preferably roll-like preliminary crusher elements 8 and 9 rotating in opposite directions, which are arranged to rotate around their parallel shafts and which are equipped with crushing cutters. The preliminary crusher elements 8 and 9 effect the preliminary crushing of the material and feed the preliminarily crushed material to the rotating element 7.

As apparent from the preceeding description, it is very simple to adjust the crusher in accordance with the present invention to crush different material groups. When both cutter element sets 5 and 6 are arranged in a cooperational relationship with the rotating element 7, only the change of the rotating direction of the rotating element 7 is needed, and the operation manner of the crusher changes from, for example, cutting crushing CC to the shocklike SC crushing or vice versa.

We claim:

1. An apparatus for comminution of different kinds of solid fuel material, comprising:

a housing, a rotating member and a comminution means, said rotating member and said communition means being supported in said housing;

said rotating member being adapted to feed the material to be comminuted and to function as a counter element for said comminution means in the comminution operation, said rotating member being arranged for rotation in two opposite directions, said comminution means including a first and a second comminution means, said first comminution means being arranged for comminution of a first group of said materials which is fed to said first comminution means by said rotating element while rotating in a first direction, and said second comminution means being arranged for comminution of a second group of materials fed to said second comminution means by said rotating element while rotating in a second direction opposite to the first direction of rotation; and wherein said first comminution means operates on a cutting principle and is particularly intended for wooden materials, and said second comminution means operates on a crushing principle and is particularly intended for sod peat and materials with similar characteristics.

2. An apparatus according to claim 1, wherein said first and said second comminution means are attached to the opposite walls of the housing so that said rotating member is substantially located therebetween, whereupon cutter/crusher edges of the comminution means are arranged in an operational cutting/crushing relationship with an outer surface of the rotating member.

3. An apparatus according to claim 2, wherein a compartment set is arranged on a cylindrical surface of said rotating member which has been dimensioned to have a depth corresponding to one dimension of the material to be crushed.

4. An apparatus according to claim 3, wherein said at least one compartment is arranged on said cylindrical surface of said rotating member between walls of radially extending portions which are spaced along the circumference of said cylindrical surface and said cylindrical surface.

5. An apparatus according to claim 1, wherein at least one compartment set is arranged on a cylindrical surface of said rotating member, which has been dimensioned to have a depth corresponding to one dimension of the material to be comminutioned.

6. An apparatus according to claim 5, wherein said at least one compartment is arranged on said cylindrical surface of said rotating member between walls of radially extending portions which are spaced along the circumference of said cylindrical surface and said cylindrical surface.

7. An apparatus according to claim 1, wherein a preliminary crushing unit is arranged in front of said rotating member in the feeding direction of said material, said preliminary crushing unit including two preliminary crusher rolls provided with a crushing edge.

* * * * *